United States Patent [19]

Aman, Jr.

[11] Patent Number: 4,586,875

[45] Date of Patent: May 6, 1986

[54] REFRIGERANT COMPRESSOR BYPASS OIL FILTER SYSTEM

[75] Inventor: Robert C. Aman, Jr., Minneapolis, Minn.

[73] Assignee: Thermo King Corporation, Minneapolis, Minn.

[21] Appl. No.: 742,159

[22] Filed: Jun. 6, 1985

[51] Int. Cl.[4] ..... F04B 39/02; F01M 1/10; B01D 29/00

[52] U.S. Cl. ..... 417/228; 417/902; 417/313; 184/6.24; 210/416.5

[58] Field of Search ..... 184/6.24; 417/228, 238, 417/902, 372, 313; 210/416.5, 234; 123/196 R; 418/88, 96, 84, 87, 89

[56] References Cited

U.S. PATENT DOCUMENTS

| | | | |
|---|---|---|---|
| 763,681 | 6/1904 | LeFebvre | 184/6.24 |
| 1,227,481 | 5/1917 | Morris | 184/6.24 |
| 1,650,917 | 11/1927 | Ward | 184/6.24 |
| 1,942,554 | 1/1934 | Kamrath | 184/6.24 |
| 2,094,195 | 9/1937 | Swart | 184/6.24 X |
| 2,488,770 | 11/1949 | Foulds | 210/234 |
| 2,544,244 | 3/1951 | Vokes | 210/234 |
| 4,406,784 | 9/1983 | Cochran | 210/416.5 X |
| 4,492,632 | 1/1985 | Mattson | 210/416.5 X |

FOREIGN PATENT DOCUMENTS

| | | | |
|---|---|---|---|
| 24780 | of 1908 | United Kingdom | 210/416.5 |

*Primary Examiner*—Carlton R. Croyle
*Assistant Examiner*—Theodore W. Olds
*Attorney, Agent, or Firm*—E. C. Arenz

[57] ABSTRACT

A bypass oil filter arrangement for a refrigerant compressor of a transport refrigeration unit is provided in which a minor portion of oil outputted by a positive displacement oil pump is fed through the filter 62 while the major portion of oil from the pump is fed through the pressurized lubricating system of the compressor as indicated by arrows 36, the oil being supplied from the high pressure pump cavity 52 which is also in communication with the pressure regulator bore 44 containing a special pressure regulator 92 having a low pressure side 90 to which oil is returned through conduit 66 from the filter 60.

3 Claims, 4 Drawing Figures

REFRIGERANT COMPRESSOR BYPASS OIL FILTER SYSTEM

BACKGROUND OF THE INVENTION

This invention pertains to the art of refrigerant compressor oil filtering systems.

A typical transport refrigeration unit with which my invention is mainly intended to be used is generally shown in U.S. Pat. No. 4,419,866, for example. As may be there seen, the refrigeration system includes a considerable number of parts such as valves, condenser, evaporator, receiver, accumulator, heat exchanger, and so on, which are assembled to make the total refrigeration system to which the refrigerant is fed from the compressor. In the system some oil is always carried through the system along with the refrigerant. This oil-refrigerant mixture makes a good degreasing and cleaning agent which will pick up and return the compressor contaminants such as rust, scale, metallic particles and dirt from any components in the system which are not totally clean. Such contaminants may also be found in a newly manufactured compressor itself, depending upon the factory environmental conditions and cleanliness standards where the compressor is made.

Since these transport refrigeration units are relatively expensive machines, production testing of substantially all is done before turning units over the customers. In such a test, lasting about an hour and during which the mechanical and refrigeration functions of the unit are checked out, the oil-refrigerant mixture circulates throughout the system and, if some parts of the system are unduly dirty, the contaminants returned to and deposited in the compressor oil sump may require that the oil be replaced. Since the compressor is part of an overall refrigeration system which is hermetically sealed, this entails certain procedures to avoid loss or depletion of the refrigerant charge. In other words, it is not as simple as merely changing oil in, say, an air compressor or internal combustion engine where the other medium (air) is not a charge that can be lost or in effect dirtied.

Even if the oil is once replaced after initial unit testing, this does not insure that there might not still be sufficient contaminants in the system that after a certain amount of additional operation, the compressor will fail due to contaminants plugging the intake to the compressor oil pump so that the pressurized lubrication system cannot deliver sufficient oil to the bearings and seals of the compressor, or the fact that the pickup screen cannot be tight enough mesh to catch all small particles of contamination without seriously restricting the needed oil volume to sustain the compressor lubricating system. These contaminants will conceivably wear on surfaces to be lubricated; therefore prematurely reducing the serviceable life of these areas.

Most refrigerant compressors for transport refrigeration units are generally similar in overall construction and typically include a positive displacement oil pump at the end of the crank shaft opposite the driven end. The oil system also includes a screen type filter of one kind or another in the oil sump to prevent the passage or larger particle contaminants from passing through the screen to the oil pump. The screen (of, say, 40 mesh) is effective to prevent larger particles from passing to the pump. However, much smaller particles can build up onto larger particles and in agglomerating fashion upon the screen to build up a pasty mass which plugs the screen so that the oil reaching the pump is insufficient to produce sufficient flow to the pressurized lubricating system, or the small particles can pass through causing wear to all lubricating surfaces. This results in loss of the compressor which, in view of the possibility that the load carried in the trailer which the unit is serving may be readily perishable and have a value magnitudes larger than the value of the compressor itself, or even the value of the refrigeration unit as a whole, can be disastrously expensive to someone.

From the foregoing it can be seen that having oil which has a limited quantity of the relatively smaller particles can prevent compressor failure due to lubrication failure. In that connection there are significant differences between oil systems for refrigerant compressors and oil systems for internal combustion engines, for example. In internal combustion engines there is constant contamination being generated by the fact of combustion, etc. and from time to time the oil must be drained and replenished. In a refrigerant compressor, the oil is being carried along with the refrigerant through the entire closed refrigeration system. If the refrigeration system as a whole is adequately clean initially, and there is the proper oil level in the compressor, the oil need never be changed.

Whether the oil in a compressor is too dirty or not due to small particles cannot be accurately determined by appearance since the oil color may be deceptive. An instrument such as a ratio turbidimeter, which uses light refraction to measure the amount of suspended solids in a liquid, can be used as an accurate determination. It has been concluded that if oil has an NTU (nephelometric turbidity units) value of less than, say, 90 NTUs, this oil will be satisfactory for extended use of compressor and, perhaps, for the life of the compressor so long as there is no subsequent internal contamination such as can occur through any opening of the refrigerant system.

The aim of this invention is to provide a bypass oil filtering system particularly adapted to filter oil for a refrigerant compressor of the type used with a transport refrigeration unit.

SUMMARY OF THE INVENTION

In accordance with the invention, a refrigerant compressor for use in a transport refrigeration unit has a crank case with a crank shaft, a pressurized lubrication system through the crank shaft, an oil sump in the crank case, an oil pump in a housing at one end of and driven by the crank shaft with the oil pump housing having first and second bores opening from external of the housing to the high pressure side of the pump, an oil leak passage having an inlet connected to the first bore and extending into the compressor to an outlet at least below the space of crank shaft turbulence in the crank case, the first bore being adapted to selectively receive a first pressure regulator with an end cap to externally close the first bore, the second bore being adapted to be selectively closed at its external end, and a bypass filtering arrangement for cleaning and/or maintaining clean the oil for the compressor including a second pressure regulator insertable into said first bore in lieu of the first pressure regulator and being open on both ends, in external oil filter of relatively high resistance to oil flow between its inlet and outlet as compared to the resistance of oil flow of the pressurized lubrication system of the compressor, first conduit means connecting the second bore to the filter inlet, second conduit means connecting the outer end of the said second pressure regulator located in said first bore to the filter outlet to return flow from said filter to the low pressure side of said second pressure regulator, so that oil taken from the high pressure side of the pump and filtered is returned to the low pressure side of the regulator and through said oil leak passage to said sump.

DESCRIPTION OF THE PREFERRED EMBODIMENT

Figure 1:
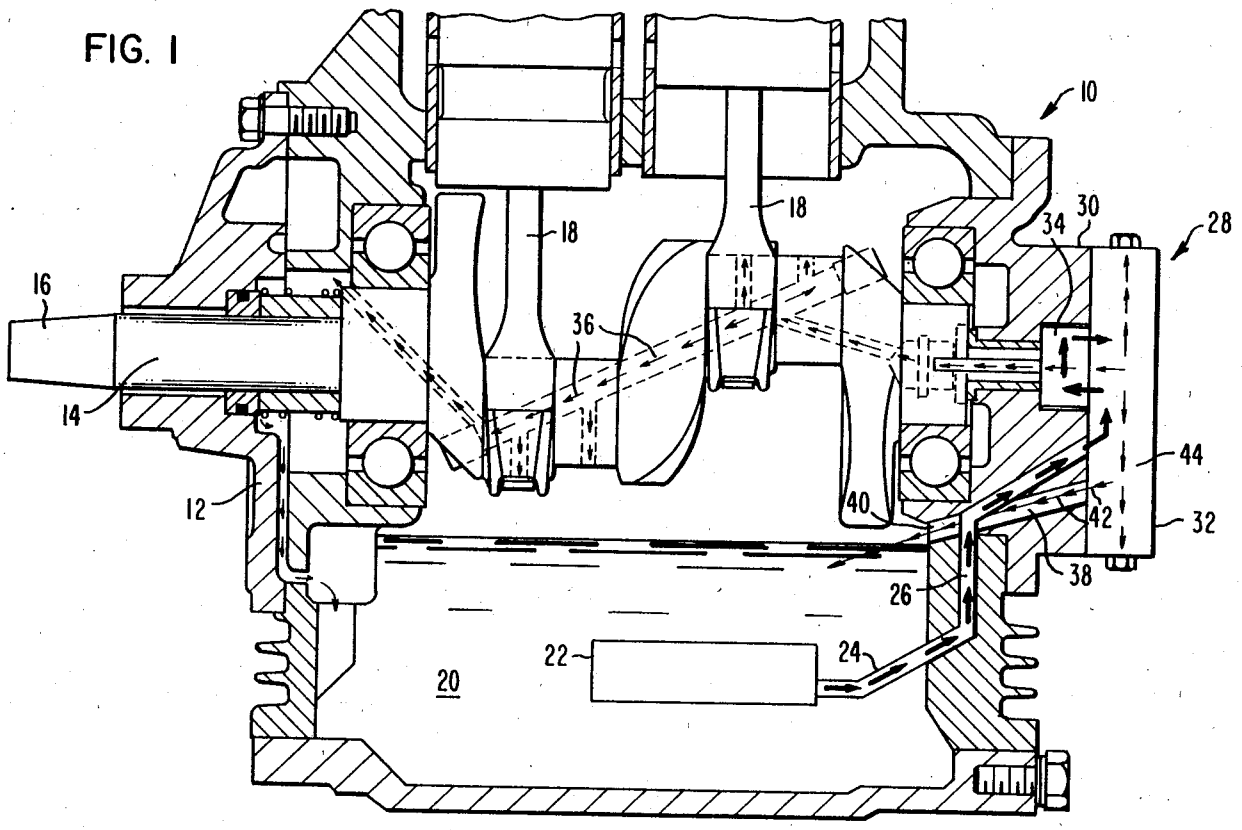
FIG. 1 is a mostly sectional view of a crank case of a refrigerant compressor with the oil pump being diagrammatically shown.

The part of the refrigerant compressor 10 shown in FIG. 1 includes a crank case 12 having a crank shaft 14 therein which, when driven at its left end 16, drives the connecting rods 18 in conventional fashion. At the bottom of the crank case is an oil sump 20 with a normal oil level as indicated and with a cylindrical screen oil filter 22 therein and connection by a pipe 24 connected to supply oil from the sump to an oil input passage 26 which connects to the input side of the oil pump 28, which is diagrammatically shown in FIG. 1. The pump 28 housing comprises a plate part 30 and a cover part 32 with a pump impeller 34 being located in the plate part. The currently preferred positive displacement oil pump is a gerotor pump having the basic construction as detailed in my U.S. Pat. No. 4,193,746, which is hereby incorporated by reference.

The heavy dash line arrows in the passage 26 indicate oil being drawn to the inlet side of the pump. The light-line arrows indicate oil which has been pressurized by the pump and at least most of which in normal operation of the compressor flows as indicated by arrows 36 through the pressurized lubricating system to lubricate bearings and seals. The compressor body also includes a leak passage 38 which has an outlet to the oil sump at 40 which, as may be seen in FIG. 1, is at a level at least as low as the space of crank shaft turbulence in the crank case, the crank shaft turbulence space comprising the space within the crank case in which the parts of the crank shaft and associated parts move. The location of this outlet being at least as low as stated is important to prevent foaming. Depending upon the particular refrigerant compressor design, the outlet 40 can be lower than shown, such as at a level at which the outlet would be at or below the normal oil level, but the outlet should not be so low as to direct return oil against any contaminating particles resting at the bottom of the oil sump. The flow of the return oil is as indicated by the solid line arrows 42 and enters the passage 38 from a pressure regulator bore 44 which is only schematically illustrated in FIG. 1.

Figure 2:
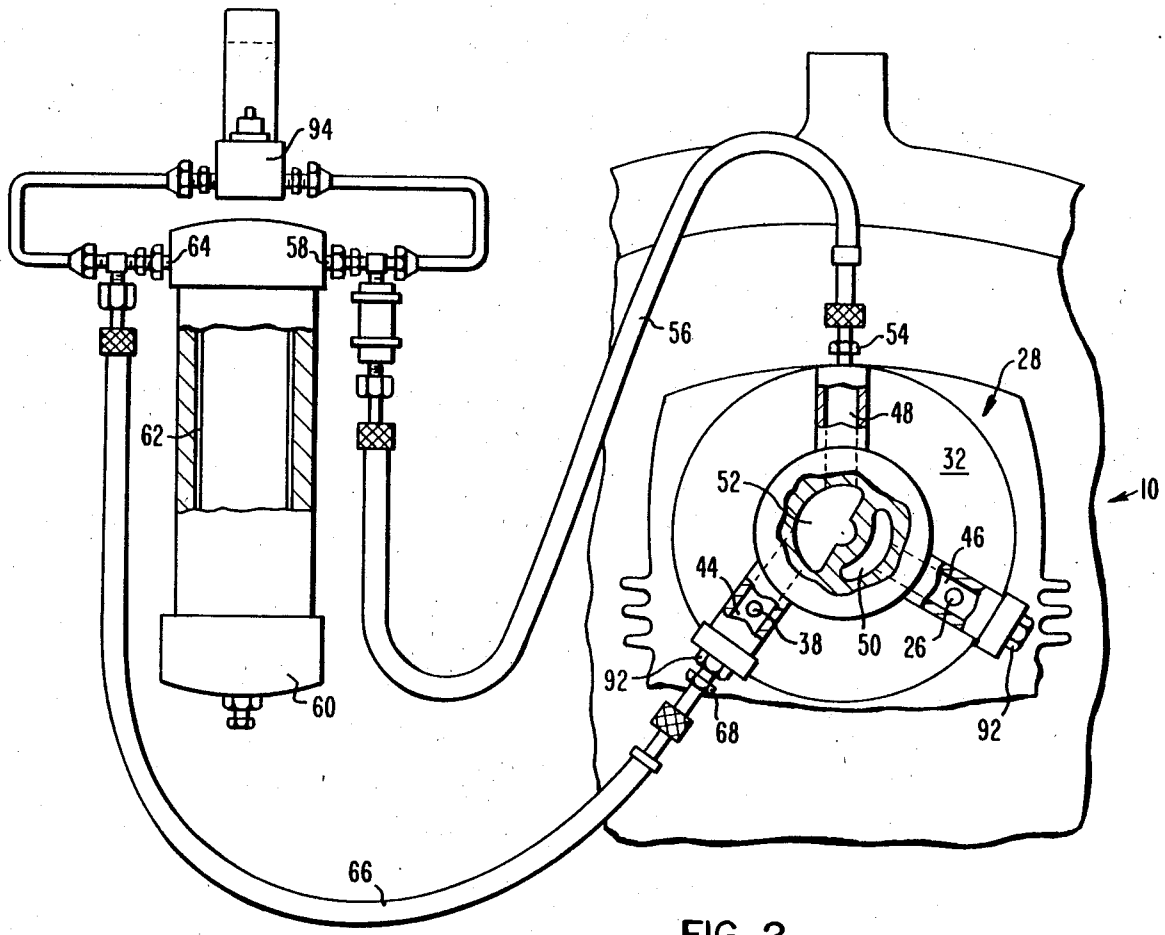
FIG. 2 is a partly broken view showing the bypass oil filter hooked up to the oil pump of the compressor.

The oil pump arrangement for purposes of this invention can perhaps best be understood in connection with FIG. 2. The cover 32 of the particular oil pump illustrated includes the pressure regulator bore 44, an oil supply bore 46 to which the passage 26 is connected, and a pressure gauge bore 48. A pair of generally-arcuate, diametrically-opposed cavities 50 and 52 are formed in the central part of the cover 32. Both the pressure regulator bore 44 and the pressure gauge bore 48 are in communication with the pressure cavity 52 while the oil supply bore 44 is in communication with the supply cavity 50. The cavities are in communication with each other only through the pump impeller 34 (not shown in FIG. 2) which occupies a cavity facing the cavities 50 and 52. To the extent that further detail of the particular pump is desired, reference should be had to my noted patent 4,193,746.

With a bypass filter arrangement according to the invention hooked up to the oil pump 28, a fitting 54 is turned into the pressure gauge bore which in turn is connected through conduit 56 through the inlet side 58 of the oil filter housing 60 which contains a high efficiency filter element 62. The currently preferred filter element to be used in the factory for a newly manufactured refrigeration system is a Balston type 100-25CX filter. Such a filter element is of somewhat higher efficiency, and accordingly more expensive, than filter elements which may be used for subsequent field service, one type filter element suitable for field service being an AMF Cuno One micron filter G78Y4. The outlet 64 of the filter housing is connected through conduit 66 through a fitting 68 to the external or low pressure side of a pressure regulator seated in the bore 44 but without the internal part of the pressure regulator shown in FIG. 2 so as to clearly show the leak passage inlet 38.

Figure 3:
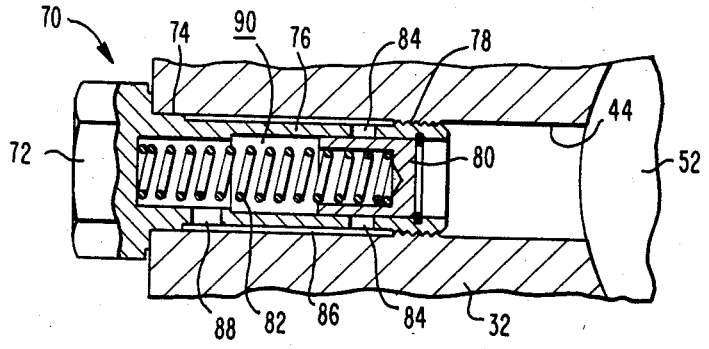
FIG. 3 is a partly broken and sectioned view showing a conventional pressure regulator which is normally used in normal operation in a bore of the oil pump.
Figure 4:
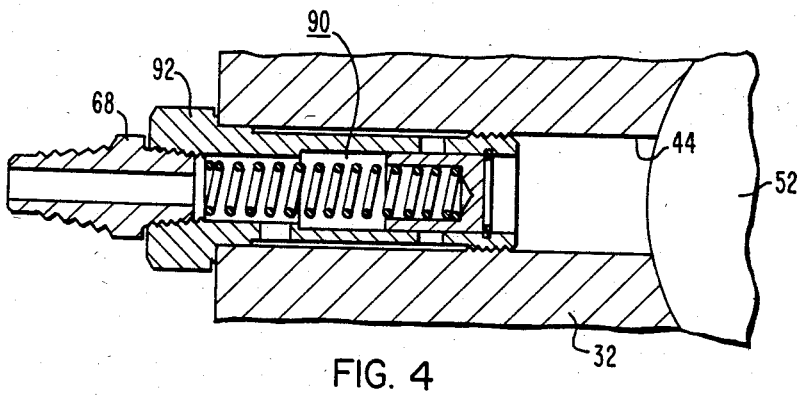
FIG. 4 is a fragmentary sectioned view of a conventional pressure regulator modified for operation in the invention.

The function of the pressure regulator is one of the important parts of the invention, and therefore details of the conventional pressure regulator and a modified pressure regulator for use in the invention are shown in FIGS. 3 and 4. The conventional pressure regulator 70 in FIG. 3 is used when the bypass filtration unit is disconnection from the oil pump. The conventional regulator of FIG. 3 includes an external cap 72 and a stepped shank including an outer end part 74 of the same diameter as the bore 44, an intermediate part 76 of lesser diameter than the bore 44 and an inner end part 78 which is externally threaded to engage with internal threads at that location in the bore 44. The regulator shank is hollow to accommodate a slidable internal plunger 80 which is biased by compression spring 82 to urge the plunger 80 to the right as seen in FIG. 3. The intermediate part 76 of the regulator shank is provided with circumferentially spaced holes 84 which are in communication with the annular space 86 defined between the bore 44 and the shank part 76. This annular space 86 is in communication with the leak passage 38. The intermediate part 76 also has one or more openings 88 toward the outer end of the regulator to preclude binding of the plunger movement by oil trapped in the low pressure space 90 of the regulator.

The way the conventional pressure regulator of FIG. 3 works is as follows. Since the high pressure space in the bore 44 is in communication with the high pressure cavity 52, which may have a pressure produced by the pump impeller of, say, 90 psi (620 E3 Pa), whereas only 45 psi (310 E3 Pa) is typically needed for wholly adequate lubrication through the pressurized lubricating system, the plunger 80 is moved to the left in FIG. 3 against the spring force so that the plunger at least partly opens the holes 84 to the high pressure oil. The spring 82 is of course selected so that the plunger can be moved sufficiently to the left to provide about 45 psi for the pressurized lubricating system.

As noted before the conventional pressure regulator 70 of FIG. 3 is only used when the bypass filter arrangement is not hooked up. In this case, the pressure gauge bore 48 (FIG. 2) is capped by either a conventional cap screw, or if desired, with a Schrader valve. The purpose of the pressure gauge bore 48 is of course to be able to connect a gauge to determine the pressure in cavity 52 for feeding the lubricating system. The oil supply bore 46 is simply capped at its outer end by another cap screw 92.

The pressure regulator to be used in connection with the invention when the bypass filter arrangement is hooked up is shown in FIG. 4 and is the same in construction as the conventional regulator of FIG. 3 except that the external cap 92 is drilled and tapped to place the low pressure space 90 in communication with the bore of fitting 68 which of course is connected to the return conduit 66 (FIG. 2) from the oil filter.

In practicing the invention, and assuming a newly assembled refrigeration system and compressor is involved, the bypass filter assembly is attached to the oil pump before evacuation and refrigerant charging of the system. The refrigeration system is then operated for a period of time to determine that it is functioning correctly both mechanically and from a refrigerant standpoint. During this time a minor part of the pressurized oil is passed through the relatively high resistance filter 62 while by far the major portion of the oil is directed through the pressurized lubricating system, this oil returning to the sump as indicated by the arrows in FIG. 1. However, during this initial testing, oil is continuously being pumped through the bypass filter and returned to the low pressure space 90 of the pressure regulator of FIG. 4. It is significant that the oil which is being "robbed" from the high pressure side of the oil pump is returned to the low pressure space of the pressure regulator of FIG. 4.

It is the purpose of the bypass filter to remove smaller particle contaminants from the oil as distinguished from larger particle contaminants which will either settle to the bottom of the oil sump, or may be caught, at least temporarily, on the screen filter 22, but in neither event are they able to reach the oil pump impeller itself.

With this arrangement, the oil-refrigerant mixture will clean the screen 22 so long as it is not substantially fully plugged, and so long as the oil itself is continued to be cleaned in the bypass filter arrangement. Thus, if a transport refrigeration unit which has been in service and has had the refrigerant system opened up for some reason such as servicing, and has accumulated some smaller particle contaminants to a degree that the flow to the oil pump is marginal, such a unit can have its oil cleaned sufficiently by applying the bypass filter arrangement to the unit during the field service testing, just as the oil is cleaned by the bypass filter in the initial factory testing.

Because of the significantly higher resistance of the bypass filter arrangement relative to the pressurized lubrication oil path, if for some reason there is a relatively low oil pump output pressure, the significantly larger quantity of flow will pass to the pressurized lubricating system. This permits cleaning the oil even if highly contaminated with small particles.

While in most cases after the oil has been adequately cleaned of small particle contaminants, the conventional pressure regulator of FIG. 3 will be substituted for that of FIG. 4 used with the filter arrangement, under some conditions of operation it may be desirable to have a bypass filter arrangement which is left hooked up to the compressor for continued use of the filter arrangement during normal operation of the unit.

I claim:

1. A refrigerant compressor and oil circulating and cleaning system comprising:

a refrigerant compressor of the type having a crank case with a crank shaft, a pressurized lubrication system through said crank shaft, an oil sump in said crank case, and an oil pump in a housing at one end of and driven by said crank shaft, with the oil pump housing having first and second bores opening from external of said housing to the high pressure side of said pump, an oil leak passage having an inlet connected to said first bore and extending into said compressor to an outlet at least below the space of crank shaft turbulence in said crank case, said first bore being adapted to selectively receive a first pressure regulator with an end cap to close said bore externally, said second bore being adapted to be closed selectively at its external end by plug means;

a second pressure regulator, having a high pressure side and a low pressure side, inserted in said first bore in place of said first pressure regulator, said low pressure side being open to external of said oil pump;

an external oil filter having a relatively high resistance to oil flow between its inlet and outlet as compared to the resistance to oil flow of said pressurized lubrication system of said compressor;

first conduit means connecting said second bore to said filter inlet in the absence of said plug means;

second conduit means connecting the lower pressure side of said second pressure regulator to said filter outlet to place the return flow from said filter in communication with said low pressure side of a second pressure regulator, so that oil taken from the high pressure side of said pump and passed through said filter is returned to the low pressure side of said regulator and through said oil leak passage to said sump.

2. A system according to claim 1 wherein:

the resistance to oil flow through said pressurized lubricating system is about 1/5 to about 1/10 the resistance to flow through said filter.

3. A system according to claim 1 wherein:

said oil leak passage outlet is closely adjacent the normal oil level in said sump.

* * * * *